US008066519B1

(12) United States Patent
Huang et al.

(10) Patent No.: US 8,066,519 B1
(45) Date of Patent: Nov. 29, 2011

(54) USB CONNECTOR

(75) Inventors: Sheng-Yuan Huang, Tu-Cheng (TW); Yung-Chi Peng, Tu-Cheng (TW); Sheng-Nan Yu, Tu-Cheng (TW)

(73) Assignee: Cheng Uei Precision Industry Co., Ltd., Tu-Chang, Taipei Hsien (TW)

( * ) Notice: Subject to any disclaimer, the term of this patent is extended or adjusted under 35 U.S.C. 154(b) by 0 days.

(21) Appl. No.: 12/948,752

(22) Filed: Nov. 17, 2010

(51) Int. Cl.
*H01R 12/00* (2006.01)

(52) U.S. Cl. ..... 439/83

(58) Field of Classification Search ..... 439/83, 439/660, 638, 607.01
See application file for complete search history.

(56) References Cited

U.S. PATENT DOCUMENTS

| | | | | |
|---|---|---|---|---|
| 6,319,061 | B1 * | 11/2001 | Chen et al. | 439/607.15 |
| 6,371,811 | B1 * | 4/2002 | Chen et al. | 439/607.37 |
| 6,419,529 | B1 * | 7/2002 | Shi et al. | 439/701 |
| 7,699,663 | B1 * | 4/2010 | Little et al. | 439/660 |
| 7,708,566 | B2 * | 5/2010 | Sabo et al. | 439/79 |
| 2004/0115990 | A1 * | 6/2004 | Kodama | 439/607 |
| 2007/0077816 | A1 * | 4/2007 | Wan et al. | 439/607 |
| 2007/0087589 | A1 * | 4/2007 | Riku | 439/69 |
| 2009/0042448 | A1 * | 2/2009 | He et al. | 439/650 |
| 2009/0111332 | A1 * | 4/2009 | Sabo et al. | 439/686 |
| 2010/0136830 | A1 * | 6/2010 | Chen et al. | 439/607.01 |
| 2010/0248552 | A1 * | 9/2010 | He et al. | 439/638 |
| 2010/0255702 | A1 * | 10/2010 | Lin et al. | 439/218 |
| 2011/0013872 | A1 * | 1/2011 | Zhang et al. | 385/93 |
| 2011/0021088 | A1 * | 1/2011 | Chen et al. | 439/732 |
| 2011/0065324 | A1 * | 3/2011 | Wan et al. | 439/638 |
| 2011/0065325 | A1 * | 3/2011 | Hsu et al. | 439/638 |

* cited by examiner

*Primary Examiner* — Tulsidas C Patel
*Assistant Examiner* — Vladimir Imas
(74) *Attorney, Agent, or Firm* — Cheng-Ju Chiang

(57) ABSTRACT

A USB (Universal Serial Bus) connector includes an insulating housing having a base portion. The base portion extends rearward to form an extending portion. Two sides of a rear surface of the extending portion define two receiving cavities, respectively. A separating wall is formed between two receiving cavities. Two side walls are formed outside the respective receiving cavities. A plurality of signal terminals fixed in the insulating housing respectively have a soldering foot received in the receiving cavity, with a distal end of the soldering foot extending beyond a bottom of the extending portion. A fixing board is inserted in bottoms of the receiving cavities. The fixing board has a base board which defines a clipping slot penetrating a front edge thereof and clipping on the separating wall and two restraining slots at two sides of the clipping slot for constraining the soldering feet of the corresponding signal terminals therein.

9 Claims, 3 Drawing Sheets

USB CONNECTOR

BACKGROUND OF THE INVENTION

1. Field of the Invention

The present invention relates to a connector, and particularly to a USB (Universal Serial Bus) connector mounted on a printed circuit board by means of soldering.

2. The Related Art

A conventional USB connector includes a dielectric housing, a plurality of signal terminals. The dielectric housing has a substantial rectangular base portion. One end of the base portion extends outward along an extending direction of the base portion to form an inserting portion. The other end of the base portion opposite to the inserting portion caves toward inside of the base portion to form a receiving cavity which penetrates through a side surface of the base portion. The inserting portion defines a plurality of terminal grooves communicating with the receiving cavity. Each signal terminal has a soldering foot. In assembly, the signal terminal passes through the receiving cavity and is secured in the terminal groove, with a part of the soldering foot received in the receiving cavity and a distal end of the soldering foot exposing beyond the side surface of the base portion to solder with a printed circuit board.

However, the receiving cavity must be designed to penetrate the side surface of the base portion to make the distal end of the soldering foot expose beyond the base portion, so the soldering foot is apt to deform and then excessively bias towards a side when an external force acts on the distal end of the soldering foot. Furthermore, as the USB connector is mounted on the printed circuit board by means of soldering the soldering foot with the printed circuit board, so the soldering temperature will be so high that may cause the base portion deform under the condition of the receiving cavity penetrating the side surface of the dielectric housing.

SUMMARY OF THE INVENTION

Accordingly, an object of the present invention is to provide a USB connector mounted on a printed circuit board. The USB connector includes an insulating housing which has a base portion. A rear surface of the base portion extends rearward to form an extending portion. Two sides of a rear surface of the extending portion define two receiving cavities, respectively, and penetrating a bottom of the extending portion. Two opposite sides of a front surface of the base portion respectively extend frontward to form an inserting portion. A separating wall is formed between two receiving cavities. Two side walls are formed outside the respective receiving cavities. A side surface of each inserting portion respectively defines a plurality of terminal grooves passing through the base portion and communicating with the corresponding receiving cavity. A shell encloses outside of the insulating housing. A plurality of signal terminals respectively have a fixing portion fixed in the terminal groove, a contacting portion extended from a front edge of the fixing portion and exposing out of the side surface of the inserting portion, and a soldering foot extended rearward and then bent downward from a rear edge of the fixing portion and received in the receiving cavity, with a distal end of the soldering foot extending beyond the bottom of the extending portion for being soldered to the printed circuit board. The soldering feet received in the same receiving cavity are substantially in alignment with each other along the extending direction of the extending portion. A fixing board is inserted in bottoms of the receiving cavities of the extending portion. The fixing board has a base board which defines a clipping slot penetrating a front edge thereof and clipping on the separating wall and two restraining slots at two sides of the clipping slot for constraining the soldering feet of the corresponding signal terminals therein.

As described above, the USB connector further has the fixing board with two restraining slots being inserted in the bottoms of the receiving cavities to make the soldering foot be restrained in the restraining slot of the fixing board, so the deformation of excessive biasing of the soldering foot will be avoided when an external force acts on the distal end of the soldering foot. Furthermore, since the fixing board is secured in the bottoms of the receiving cavities and abuts against the side wall, the deformation of the side walls toward insides of the receiving cavity will be avoided even when the USB connector solders on the printed circuit board with much higher temperature which induces the side walls deform toward insides of the receiving cavity.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
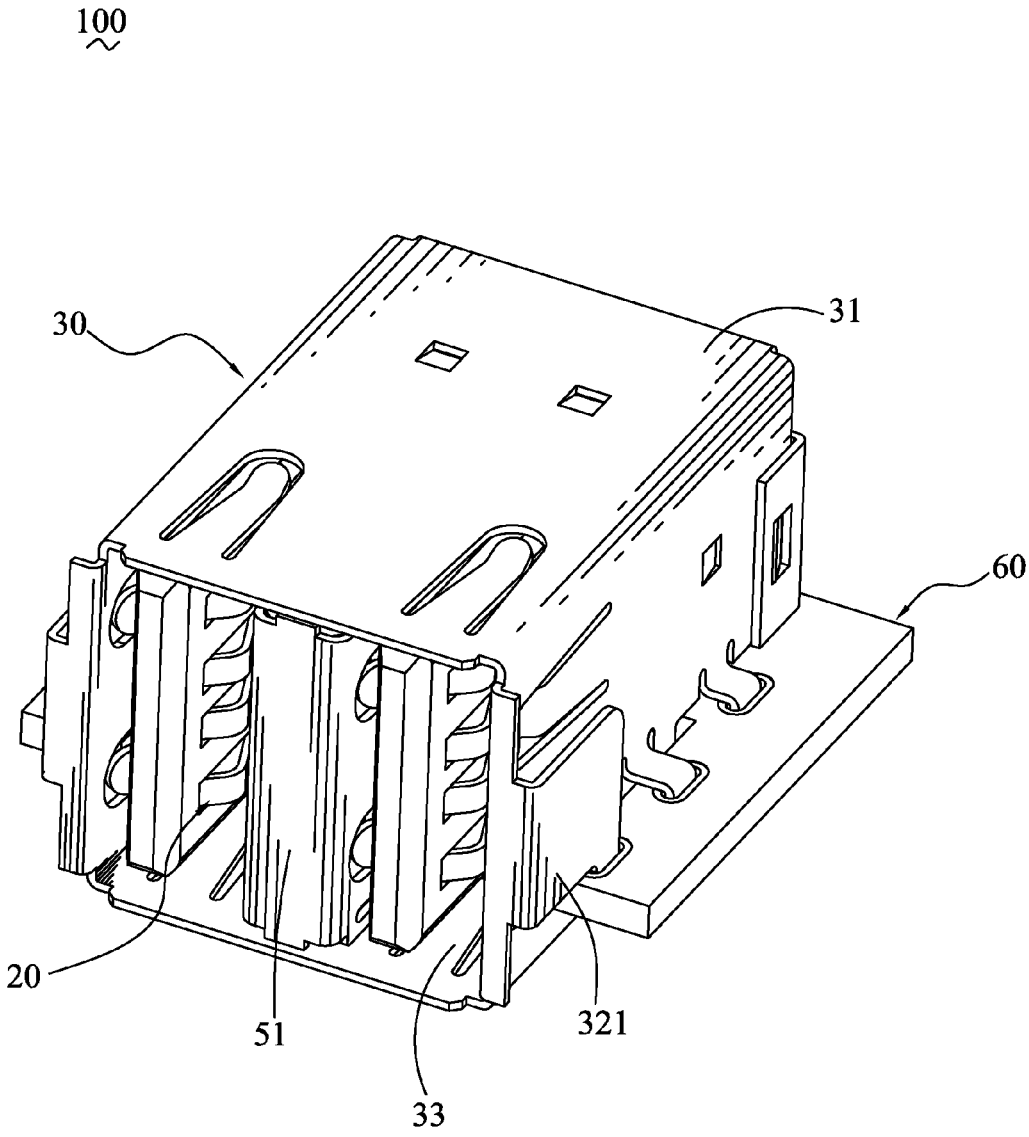
FIG. 1 is a perspective view of an USB connector mounted in a printed circuit board in accordance with the present invention.
Figure 2:
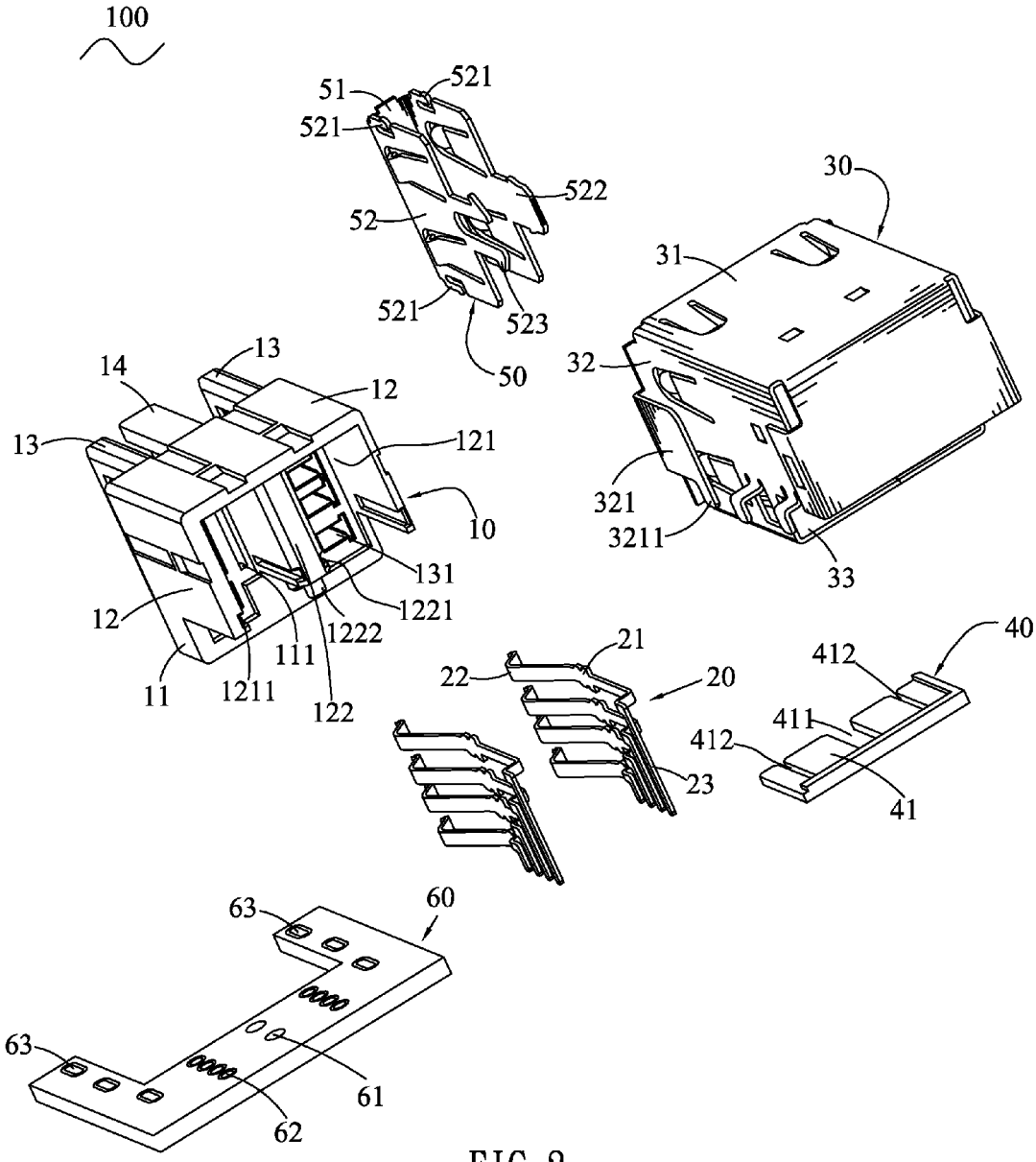
FIG. 2 is an explored, perspective view of the USB connector and the printed circuit board of FIG. 1.

Referring to the drawings in greater detail, and first to FIG. 1 and FIG. 2, the embodiment of the invention is embodied in a USB connector 100. The USB connector 100 has an insulating housing 10, a plurality of signal terminals 20, a shell 30, a fixing board 40 and a flexible element 50.

Figure 3:
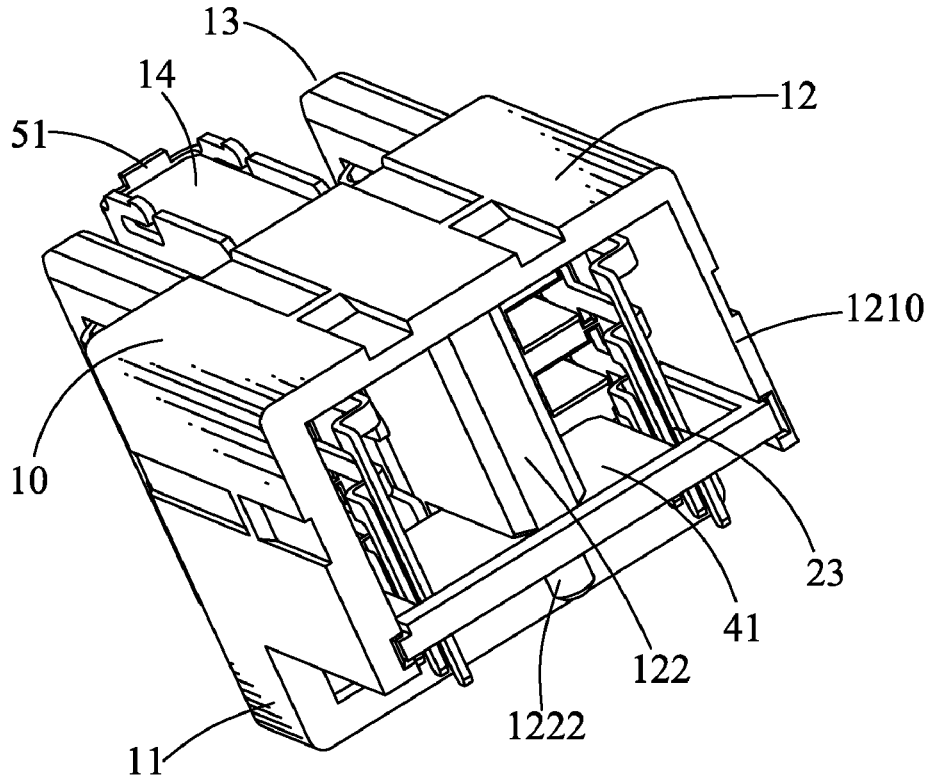
FIG. 3 is an assembled, perspective view of an insulating housing, a plurality of signal terminals, and a flexible element of the USB connector of FIG. 2.

Referring to FIG. 51-3, the insulating housing 10 has a substantially rectangular base portion 11. An upper portion of a rear surface of the base portion 11 extends rearward to form an extending portion 12 to make the base portion 11 and the extending portion 12 together be shown inverted-L shape. A rear surface of the extending portion 12 defines two receiving cavities 121 parallel with each other and respectively penetrating a bottom of the extending portion 12. Two side walls 1210 are formed outside the respective receiving cavities 121. An inside of each side wall 1210 defines a matching groove 1211 penetrating a rear end thereof. A separating wall 122 is formed between the two adjacent receiving cavities 121. A bottom of each side surface of the separating wall 122 respectively defines a fixing groove 1221 penetrating a rear end of the separating wall 122. A bottom surface of the separating wall 122 extends downward to form two fixing pillars 1222. Two opposite sides of a front surface of the base portion 11 respectively extend frontward to form an inserting portion 13. A side surface of each inserting portion 13 defines a plurality of terminal grooves 131 passing through the base portion 11 and communicating with the receiving cavity 121. A substantial middle of the front surface of the base portion 11 extends frontward to form a separating portion 14 parallel with the inserting portion 13 and defines two locking holes 111 at two sides of the separating portion 14 and communicating with the receiving cavities 121.

Referring to FIG. 2, the signal terminal 20 has a fixing portion 21 fixed in the terminal groove 131, a contacting portion 22 extended and bent from a front end of the fixing portion 21, and a soldering foot 23 extended rearward and then bent downward from a rear end of the fixing portion 21.

Referring to FIG. 51-2, the shell 30 has a rectangular top plate 31. Two opposite side edges of the top plate 31 are extended downward to form two side plates 32 parallel with each other. A bottom plate 33 connects bottoms of two side plates 32. The bottom plate 33 is parallel with the top plate 31. The top plate 31, the bottom plate 33 and two opposite side plates 32 collectively define a receiving room 34 for accommodating the insulating housing 10 therein. A front edge of the side plate 32 extends outward and then bent rearward to form a connecting plate 321 which has a fixing foot 3211 extended from a bottom edge of the fixing plate 321.

Referring to FIG. 2 and FIG. 3, the fixing board 40 is of substantial rectangular shape and has a base board 41. The base board 41 defines a clipping slot 411 and two restraining slots 412 respectively at two sides of the clipping slot 411. The clipping slot 411 and two restraining slots 412 penetrate through a front edge of the base board 41.

Referring to FIG. 51-2 again, the flexible element 50 has a substantial rectangular main plate 51. Two opposite side edges of the main plate 51 respectively extend rearward to form a clipping plate 52. Two opposite side edges of each clipping plate 52 respectively have a buckle 521. A middle of a rear edge of one clipping plate 52 of the flexible element 50 is extended rearward to form an inserting plate 522. A middle of a rear edge of the other clipping plate 52 of the flexible element 50 is extended rearward to form a pair of lock arms 523.

Referring to FIG. 51-3, in assembly, the signal terminal 20 is secured in the terminal groove 131. The fixing portion 21 is fixed in the terminal groove 131. The contacting portion 22 elastically exposes out of the side surface of the inserting portion 13. The soldering foot 23 is received in the receiving cavity 121, with a distal end of the soldering foot 23 extending beyond the bottom of the extending portion 12. The soldering feet 23 located in the same receiving cavity 121 is in alignment with each other along the extending direction of the extending portion 12. The flexible element 50 encloses outside of the separating portion 14 of the insulating housing 10. The main plate 51 abuts against a front end of the separating portion 14. The clipping plates 52 are respectively attached on two sides of the separating portion 14. The inserting plate 522 and the lock arms 523 of the clipping plate 52 are secured in the locking holes 111 of the base portion 11. The buckle 521 is against an inside of the shell 30. The fixing board 40 is inserted into bottoms of the receiving cavities 121 of the extending portion 12. The clipping slot 411 of the fixing board 40 matches with the fixing grooves 1221 of the separating wall 122 to make the clipping slot 411 clip on the separating wall 122. Two opposite side ends of the fixing board 40 are respectively mounted in the matching grooves 1211. The soldering feet 23 of the signal terminals 20 are positioned in the respective restraining slots 412 of the base board 41.

Referring to FIG. 51-2 again, the USB connector 100 is mounted on and electrically connected with a printed circuit board 60. The printed circuit board 60 defines two mounting holes 61 at a middle thereof and in alignment with each other, two rows of soldering holes 62 at two sides of the mounting holes 61, and two fixing holes 63 disposed adjacent to side edges thereof.

Referring to FIG. 51-2 again, when the USB connector 100 is mounted on the printed circuit board 60, the distal ends of the soldering feet 23 are accommodated and soldered in the mounting holes 61. The fixing pillars 1222 of the separating wall 122 are mounted in the soldering holes 62 of the printed circuit board 60. The fixing feet 3211 of the fixing plate 321 are inserted in the fixing holes 63 of the printed circuit board 60 and integrate with the printed circuit board 60 by means of soldering to avoid the USB connector 100 breaking off from the printed circuit board 60 when a mating connector (not shown) obliquely inserts into the USB connector 100. So such structure can assure the stable connection between the USB connector 100 and the printed circuit board 60. Since the soldering foot 23 is restrained in the restraining slot 412 of the fixing board 40, the deformation and excessive biasing of the soldering foot 23 will be avoided when an external force acts on the distal end of the soldering foot 23. Furthermore, since the fixing board 40 is secured in the bottoms of the receiving cavities 121 and abuts against the side wall 1210, the deformation of the side walls 1210 toward insides of the receiving cavity 121 will be avoided even when the USB connector 100 solders on the printed circuit board 60 with much higher temperature which induces the side walls 1210 deform toward insides of the receiving cavity 121.

As described above, the USB connector 100 further has the fixing board 40 with two restraining slots 412 being inserted in the bottoms of the receiving cavities 12 to make the soldering foot 23 be restrained in the restraining slot 412 of the fixing board 40, so the deformation of excessive biasing of the soldering foot 23 will be avoided when an external force acts on the distal end of the soldering foot 23. Furthermore, since the fixing board 40 is secured in the bottoms of the receiving cavities 121 and abuts against the side wall 1210, the deformation of the side walls 1210 toward insides of the receiving cavity 121 will be avoided even when the USB connector 100 solders on the printed circuit board 60 with much higher temperature which induces the side walls 1210 deform toward insides of the receiving cavity 121.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A USB (Universal Serial Bus) connector mounted on a printed circuit board, comprising:

an insulating housing having a base portion, a rear surface of the base portion extending rearward to form an extending portion, two sides of a rear surface of the extending portion defining two receiving cavities, respectively, and penetrating a bottom of the extending portion, two opposite sides of a front surface of the base portion respectively extended frontward to form an inserting portion, a separating wall being formed between two receiving cavities, two side walls being formed outside the respective receiving cavities, a side surface of each inserting portion respectively defining a plurality of terminal grooves passing through the base portion and communicating with the corresponding receiving cavity;

a shell enclosing outside of the insulating housing;

a plurality of signal terminals respectively having a fixing portion fixed in the terminal groove, a contacting portion extended from a front edge of the fixing portion and exposing out of the side surface of the inserting portion, and a soldering foot extended rearward and then bent downward from a rear edge of the fixing portion and received in the receiving cavity, with a distal end of the soldering foot extending beyond the bottom of the extending portion for being soldered to the printed circuit board, the soldering feet received in the same receiving cavity being substantially in alignment with each other along the extending direction of the extending portion; and a fixing board inserted in bottoms of the receiving cavities of the extending portion, the fixing board having a base board, the base board defining a clipping slot penetrating a front edge thereof and clipping on the separating wall, and two restraining slots at two sides of the clipping slot for constraining the soldering feet of the corresponding signal terminals therein.

2. The USB connector as claimed in claim 1, wherein a bottom of each side surface of the separating wall defines a fixing groove penetrating a rear end of the separating wall, the clipping slot of the fixing board matches with the fixing grooves.

3. The USB connector as claimed in claim 2, wherein an inside of each side wall defines a matching groove penetrating a rear end thereof and in alignment with the fixing grooves, two side ends of the fixing board are respectively mounted in the matching grooves.

4. The USB connector as claimed in claim 1, wherein an inside of each side wall defines a matching groove penetrating a rear end thereof, two side ends of the fixing board are respectively mounted in the matching grooves.

5. The USB connector as claimed in claim 1, wherein a bottom surface of the separating wall extends downward to form a fixing pillar for being inserted into a mounting hole of the printed circuit board.

6. The USB connector as claimed in claim 1, wherein a substantial middle of the front surface of the base portion extends frontward to form a separating portion parallel with the inserting portion and enclosed by a flexible element, the flexible element includes a main plate covering a front end of the separating portion, two opposite side edges of the main plate respectively extend rearward to form a clipping plate being attached on a side surface of the separating portion, two side edge of each clipping plate have a buckle against the shell.

7. The USB connector as claimed in claim 6, wherein a middle of a rear edge of one clipping plate of the flexible element is extended rearward to form an inserting plate, a middle of a rear edge of the other clipping plate of the flexible element is extended rearward to form a pair of lock arms, a middle of the front surface of the base portion defines two locking holes at two sides of the separating portion and communicating with the receiving cavities, the inserting plate and the lock arms of the clipping plate are secured in the locking holes of the base portion.

8. The USB connector as claimed in claim 1, wherein the shell has two side plates parallel with each other, a front edge of the side plate is extended outward and then bent rearward to form a fixing plate which has a fixing foot extended from a bottom of the fixing plate for being inserted into a fixing hole of the printed circuit board.

9. The USB connector as claimed in claim 1, wherein the extending portion is extended from an upper portion of the base portion to make the base portion and the extending portion together be shown inverted-L shaped.

* * * * *